US007676876B1

(12) United States Patent
Ewert

(10) Patent No.: US 7,676,876 B1
(45) Date of Patent: Mar. 16, 2010

(54) FOOTWEAR WASHER

(76) Inventor: Terry Ewert, 814 First Ave., Dorchester, WI (US) 55425

( * ) Notice: Subject to any disclaimer, the term of this patent is extended or adjusted under 35 U.S.C. 154(b) by 0 days.

(21) Appl. No.: 12/260,268

(22) Filed: Oct. 29, 2008

(51) Int. Cl.
*A47L 23/02* (2006.01)

(52) U.S. Cl. ..... 15/37; 15/30; 15/33; 15/36

(58) Field of Classification Search ..... 15/30–37
See application file for complete search history.

(56) References Cited

U.S. PATENT DOCUMENTS

| | | | | | |
|---|---|---|---|---|---|
| 173,707 | A | | 2/1876 | Worley | |
| 524,414 | A | * | 8/1894 | Christenson | 15/37 |
| 595,581 | A | * | 12/1897 | Rinker | 15/35 |
| 640,920 | A | * | 1/1900 | Kratofil et al | 15/36 |
| 693,531 | A | * | 2/1902 | McKee et al | 15/37 |
| 706,091 | A | * | 8/1902 | Nicolet | 15/37 |
| 1,021,814 | A | * | 4/1912 | Amadeo | 15/33 |
| 1,335,388 | A | | 3/1920 | Raginia | |
| 1,420,540 | A | * | 6/1922 | Giandalia | 15/33 |
| 1,887,906 | A | * | 11/1932 | Spruill | 15/31 |
| 2,577,294 | A | | 12/1951 | Aben | |
| 2,963,723 | A | | 12/1960 | Nappi | |
| 3,066,338 | A | * | 12/1962 | Nappi | 15/34 |
| 3,365,741 | A | | 1/1968 | Smagula | |
| 3,383,726 | A | | 5/1968 | Chapin | |
| 3,526,015 | A | * | 9/1970 | Nappi | 15/36 |
| 3,729,761 | A | | 5/1973 | Lashley | |
| 3,737,942 | A | * | 6/1973 | Casey | 15/339 |
| 3,849,822 | A | | 11/1974 | Ouellette | |
| 4,024,599 | A | | 5/1977 | Gamboa | |
| 4,724,564 | A | | 2/1988 | Fresh | |
| 5,025,528 | A | | 6/1991 | Burey et al. | |
| 6,557,203 | B2 | | 5/2003 | Meshbesher | |
| 6,584,636 | B2 | | 7/2003 | Schlem | |
| 6,668,842 | B1 | | 12/2003 | Wilke et al. | |
| 6,912,752 | B2 | | 7/2005 | Ferrari | |
| 7,114,212 | B1 | | 10/2006 | Watts | |
| 2003/0051300 | A1 | * | 3/2003 | Ferrari | 15/36 |
| 2008/0104782 | A1 | | 5/2008 | Hughes | |

* cited by examiner

*Primary Examiner*—Mark Spisich
(74) *Attorney, Agent, or Firm*—Z. Peter Sawicki; Westman, Champlin & Kelly, P.A.

(57) ABSTRACT

An apparatus for cleaning footwear includes a chamber having a toe area, a heel area, two opposed side areas and a bottom area. In one aspect, the apparatus includes two linearly reciprocating side brushes, wherein one side brush is disposed in each side area, each side brush being movable along a first direction. In another aspect, the apparatus includes two side brushes, the side brushes being linearly movable toward each other and way from each other.

19 Claims, 7 Drawing Sheets

FOOTWEAR WASHER

BACKGROUND

The present disclosure relates to an automatic footwear cleaning apparatus. In industrial settings, such as food processing plants, it is important for plant personnel to sanitize their footwear when entering or exiting different processing rooms or areas. However, conventional methods of cleaning with a manual brush, water, and soap may take up undesirable amounts of time and result in inconsistent cleaning. Automatic cleaning machines that use electricity can be dangerous in wet environments. Thus, there is a need for a footwear cleaning device that is safe, effective, and efficient.

BRIEF SUMMARY

An apparatus for cleaning footwear includes a chamber having a toe area, a heel area, two opposed side areas and a bottom area. In one aspect, the apparatus includes two linearly reciprocating side brushes, wherein one side brush is disposed in each side area, each side brush being movable along a first direction. In another aspect, the apparatus includes two side brushes, the side brushes being linearly movable toward each other and way from each other.

This Summary is provided to introduce a selection of concepts in a simplified form that are further described below in the Detailed Description. This Summary is not intended to identify key features or essential features of the disclosed or claimed subject matter, is not intended to describe each disclosed embodiment or every implementation of the disclosed or claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views.

While modifiers such as top, bottom, left, right, above, and below, etc. may be used in this description, they are used for ease of comprehension only. It is to be understood that the discussed components may be oriented otherwise. While the above-identified figures set forth one or more embodiments of the disclosed subject matter, other embodiments are also contemplated. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION OF ILLUSTRATIVE EMBODIMENTS

In one aspect, this disclosure relates to an automated footwear cleaning apparatus. A feature of the apparatus includes moving brushes that are powered completely by pneumatics, thereby eliminating electrical hazards in wet areas. Four low-profile bottom brushes reciprocate across the footwear sole in alternating pairs. This arrangement ensures proper contact with the sole and the low-profile design allows for a more compact washer unit. Stationary brushes are located at the top and bottom of the cleaning area to allow for cleaning of the toe and heel of a shoe or boot. Low-profile, reciprocating side brush assemblies are laterally displaceable to squeeze inward toward each other to adjust for various boot widths, thereby ensuring contact. The unit features an integral foam generator and spray mechanism for a washing and disinfecting fluid. A hand rail to help a user balance and an inclined shoe position allow for increased comfort and safety. A manual control valve is located on the handrail for convenient operator control. The unit easily disassembles for sanitation.

Figure 1:
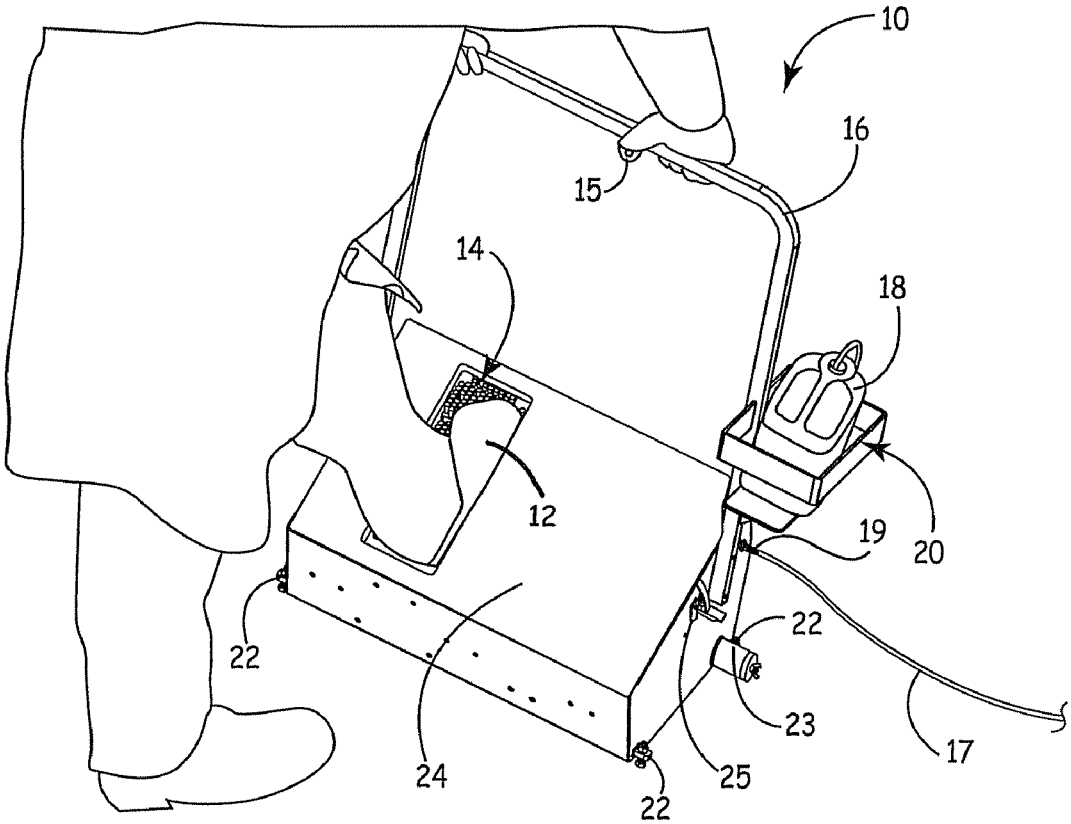
FIG. 1 is perspective view of a person using an exemplary automated footwear washer.

FIG. 1 is a perspective view from the front and top of an exemplary automated footwear washer 10. In an exemplary embodiment, the floor surface covered by footwear washer 10 is about 19 inches deep and about 30 inches wide. This compact design allows footwear washer 10 to fit into tight spaces. Footwear washer 10 is preferably located near a drain and on a relatively level floor. After positioning footwear washer 10, the unit may be leveled by adjusting foot screws 22. Drain 23 may be plugged as shown or may be attached to a hose leading to a floor drain. For safety, footwear washer 10 should be operated only when cover 24 is in place and retained by cover latches 25.

A person, shown partially, inserts his or her footwear 12 into cleaning chamber 14 and activates automated footwear washer 10 by pressing a control valve button on hand rail 16. Power is supplied to footwear washer 10 through pneumatic tube 17. In an exemplary embodiment, pneumatic tube 17 is connected to a clean, dry air source at about 60-130 pounds per square inch of pressure and a flow rate of at least about 2.5 standard cubic feet per minute (SCFM). Pneumatic tube 17 is connected to footwear washer 10 at main air inlet 19.

Such activation causes the following to happen: side brush assemblies 36 squeeze inward to adjust automatically to a width of footwear 12; the side brushes linearly reciprocate along the length of footwear 12; and bottom brushes linearly reciprocate from side to side (in the direction of the width of the footwear) to clean a sole of footwear. Additionally, stationary brushes are provided at the toe and heel areas of cleaning chamber 14 to further remove debris and germs. In an exemplary embodiment, while the side and bottom brushes 36, 32 reciprocate, a cleaning fluid is dispensed into cleaning chamber 14 from jug 18, positioned in holder 20. The cleaning fluid sprays into chamber 14 from spray bars located in the toe, heel, and side brush assemblies. The cleaning fluid contained in jug 18 is preferably a sanitizing chemical. A particularly suitable cleaning fluid is a 1,000-1,500 part per million (ppm) quaternary ammonium biocide solution. When the user releases the activation button 15, the brush reciprocation action ceases, the side brush assemblies move away from each other to return to their original positions, and no additional cleaning fluid is dispensed into cleaning chamber 14.

In an exemplary embodiment, each brush in cleaning chamber 14 is a low-profile stationary brush (toe and heel brushes, for example) or a low-profile linearly reciprocating brush (side and bottom brushes, for example). Exemplary low-profile brushes have relatively short bristles arranged on and extending from a planar surface. Thus, they can take up less space than other moving brushes, such as cylindrical rotary brushes. The flat brushes also ensure greater surface contact with footwear 12 than typical rotary brushes.

Figure 2:
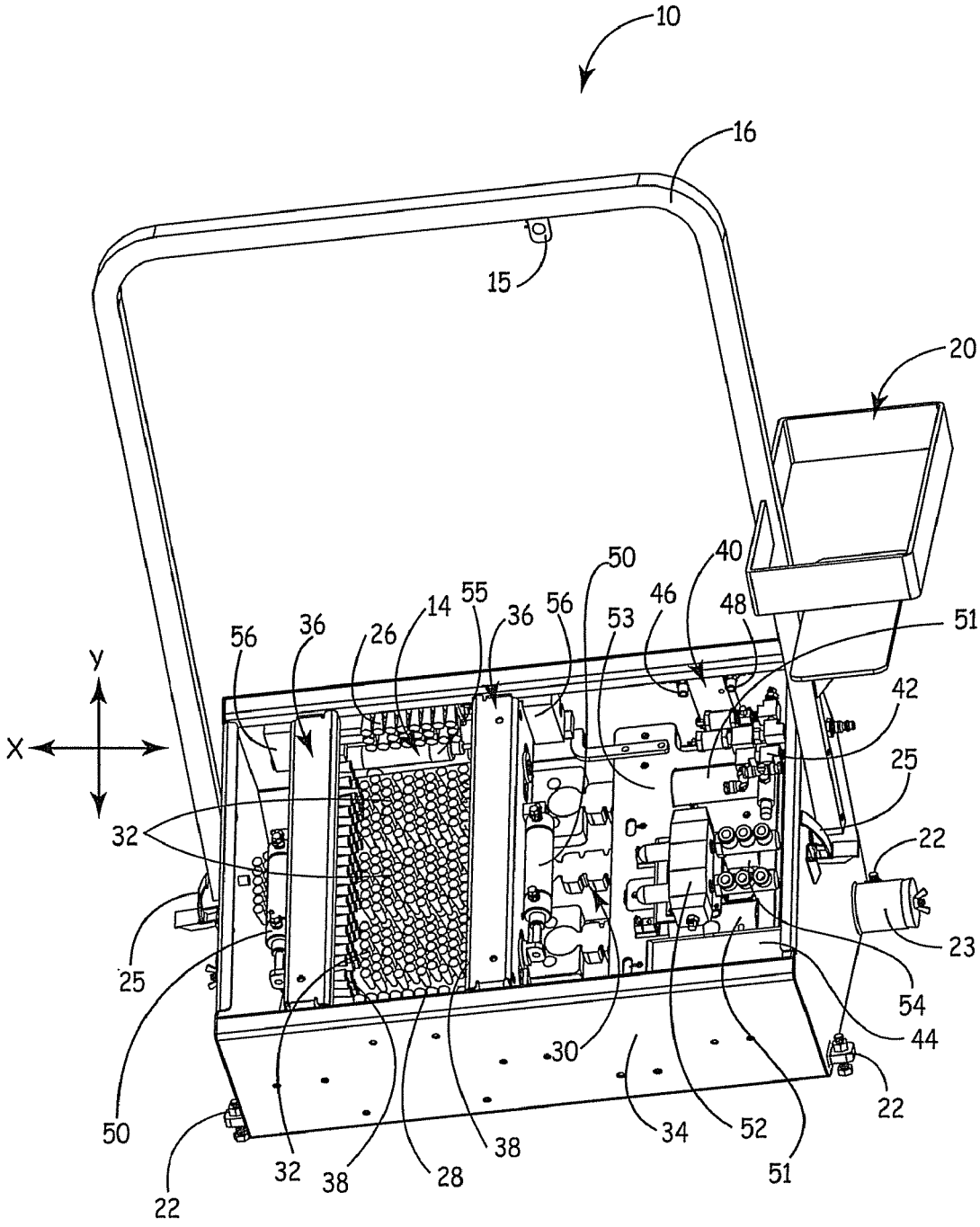
FIG. 2 is a front perspective view of an exemplary footwear washer, with the cover removed.

FIG. 2 is a front perspective view of an exemplary footwear washer 10 with pneumatic tube 17 and cover 24 removed. In this and following illustrations, some conventional pneumatic and cleaning fluid tubing are not shown for clarity of illustration. However, the discussion will refer to fluid communication and connection of the components, and it should be understood that tubing may be used for the connections.

In an exemplary embodiment, toe brush 26 and heel brush 28 are stationary. Bottom brush assembly 30 includes four reciprocating bottom brushes 32 (the fourth bottom brush is not visible because it is hidden by front panel 34 in this view). When activated, bottom brushes 32 reciprocate along direction "x," corresponding with movement from side to side along a width of the footwear, at a rate of about 2 to 3 cycles per second. Side brush assemblies 36 include side brushes 38. Upon activation, side brush assemblies 36 also move laterally along direction "x" toward each other to contact the sides of footwear 12 inserted in chamber 14. Side brushes 38 also reciprocate along direction "y," corresponding with movement back and forth along a length of the footwear, at a rate of about 2 to 3 cycles per second in an exemplary embodiment. As used herein, the "x" and "y" directions are mutually perpendicular linear paths along which there can be opposite motions (e.g., forward and backward, side-to-side). In one embodiment, bottom brushes 32 and side brushes 38 travel about 2 inches in each direction during reciprocation. Valve assembly 42 controls the use of air pressure supplied through pneumatic tube 17.

Side brush cylinders 50 are aligned in the "y" direction to allow for reciprocation of side brushes 38 in the "y" direction. Bottom brush cylinders 51 are linearly aligned with bottom brushes 32 and are located under main plate 53. The bottom brush cylinders 51 are aligned in the "x" direction to allow for reciprocation of bottom brushes 32 in the "x" direction. Valve assembly 42 connects pneumatic tube 17 to reciprocating valve 52. Reciprocating valve 52 is in turn connected to the bottom brush assembly 30 and the side brush assemblies 36 via manifold 54.

Foam generator 40 is connected to pump 44 via tubing (not shown) between fluid flow control valve 46 and pump 44 and via tubing (not shown) between air flow control valve 48 and pump 44. A particularly suitable pump 44 is available from FLOJET™. Foam generator 40 produces foam by mixing the cleaning fluid contained in jug 18 with air. The foam is then distributed by pump 44 and suitable tubing to spray bars located proximate toe brush 26, heel brush 28 and upper portions of side brush assemblies 36.

Figure 3:
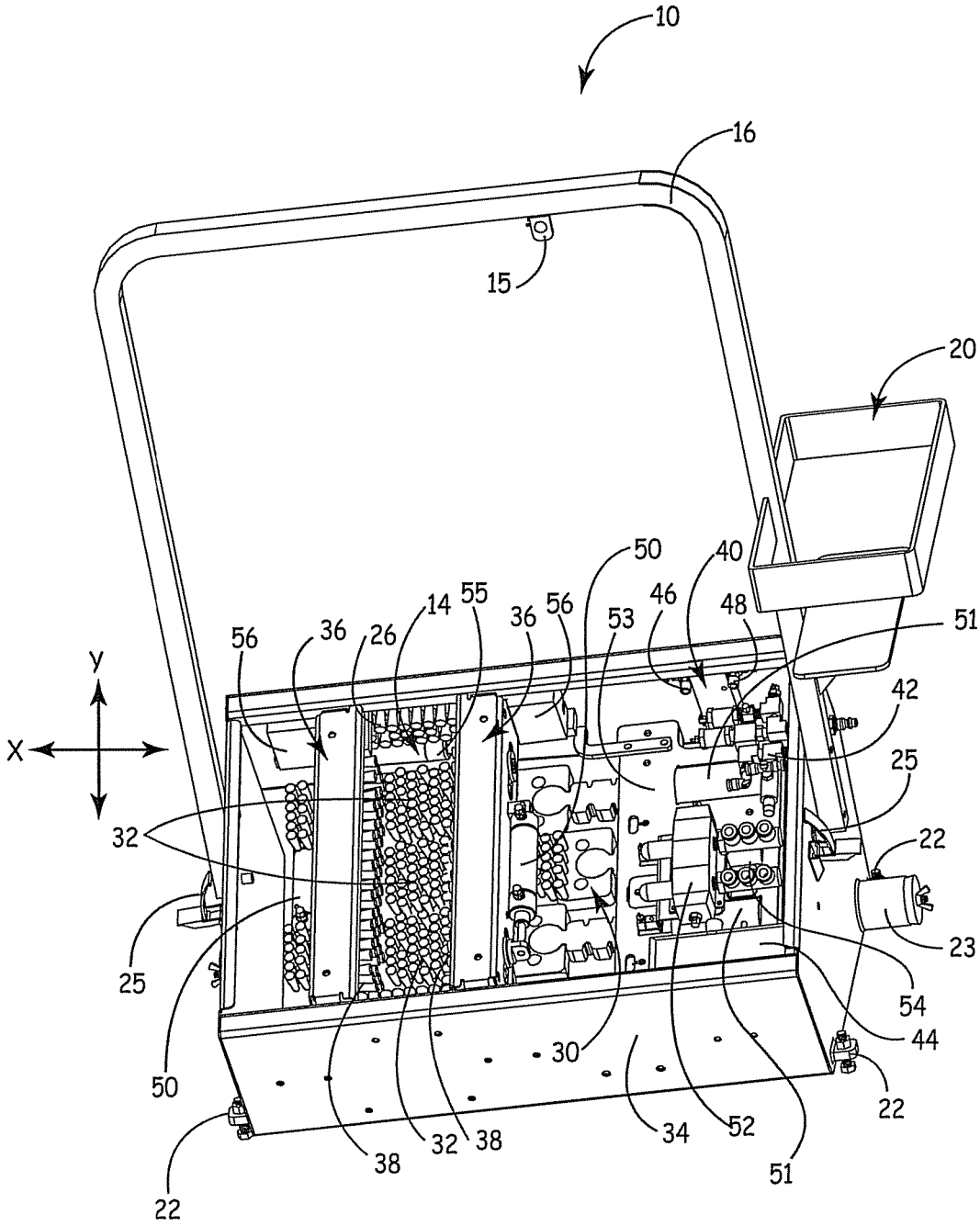
FIG. 3 is similar to FIG. 2, but shows lateral movement of the side brush assemblies.

FIG. 3 is similar to FIG. 2, except that in FIG. 3, side brush assemblies 36 have moved toward each other on track blocks 56 to adjust for a width of footwear 12 inserted into cleaning chamber 14, thus ensuring contact between reciprocating side brushes 38 and the left and right sides of the footwear 12. In an exemplary embodiment, the displacement of side brush assemblies 36 along direct "x" automatically adjusts for the width of footwear 12, without exerting excessive pressure on the footwear 12.

Figure 4:
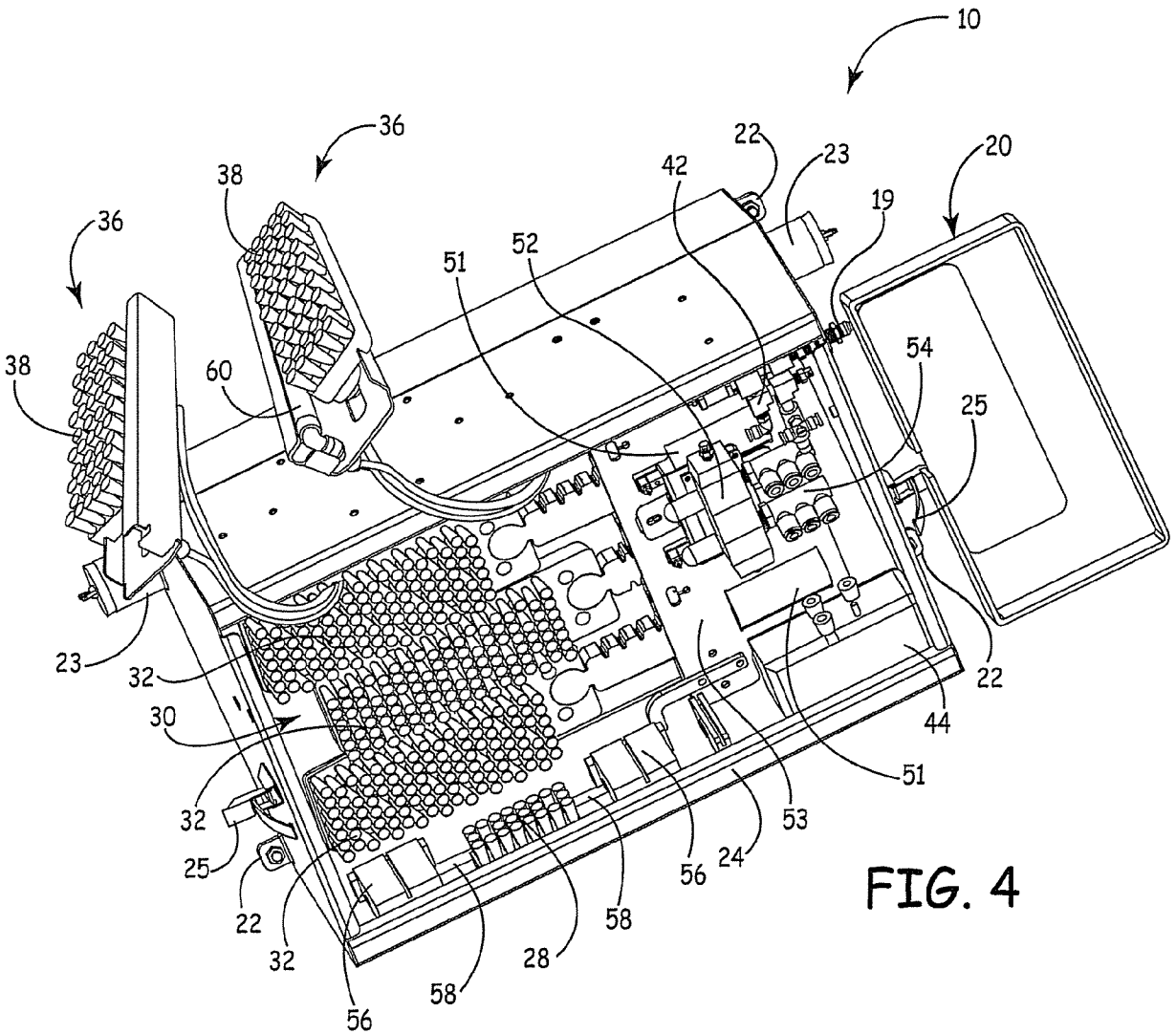
FIG. 4 is a top perspective view of an exemplary automated footwear washer with the side brush assemblies removed.
Figure 5:
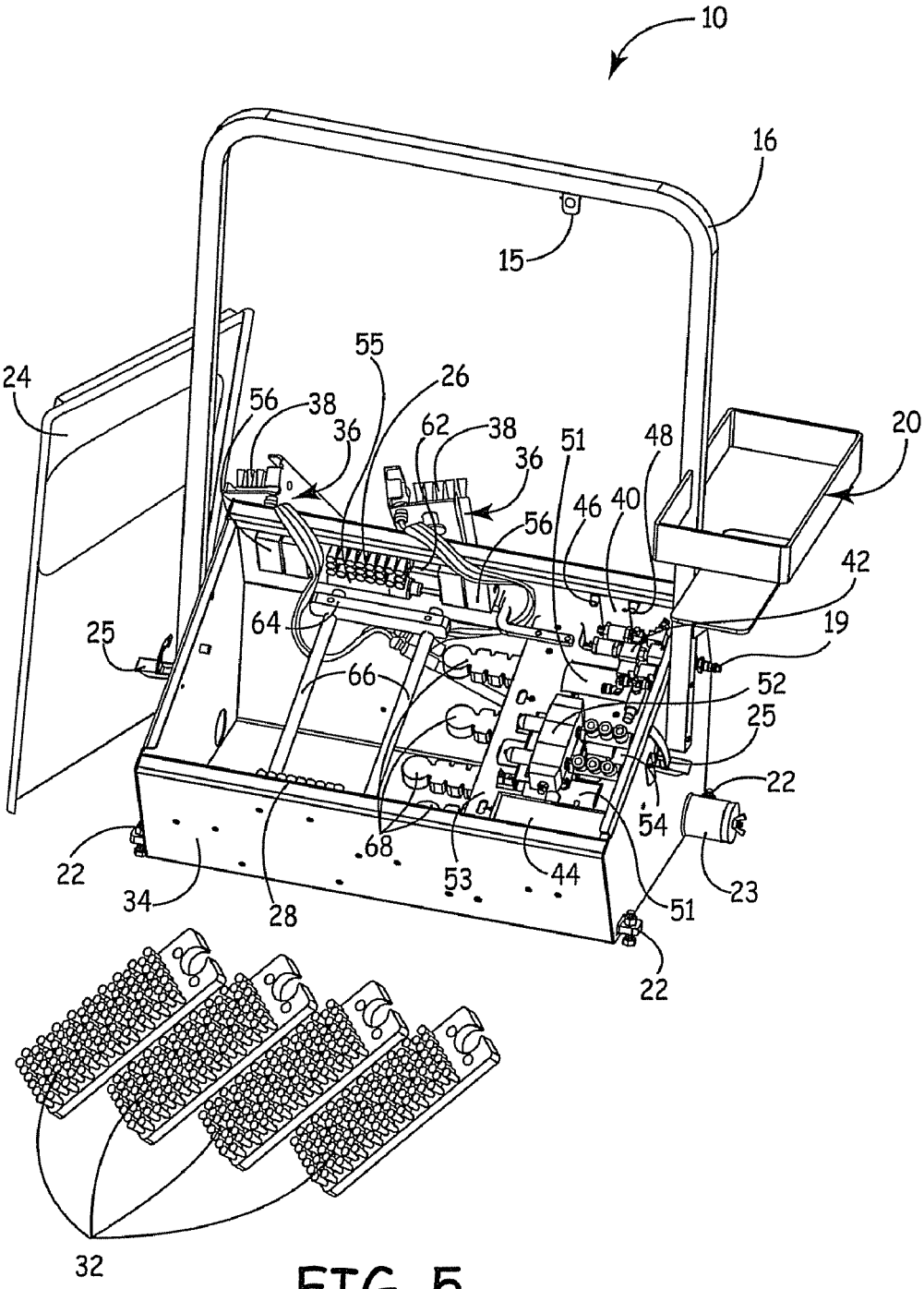
FIG. 5 is a front perspective view of an exemplary footwear washer with the side brush assemblies and the bottom brushes removed.

FIG. 4 is a perspective view from the back and top of footwear washer 10. FIGS. 4 and 5 illustrate disassembly of footwear washer 10 for cleaning or repair. In FIG. 4, side brush assemblies 36 have been removed. Side brush cylinders 50 and hand rail 16 are not shown in this view. In this view, heel spray bar 58 and one side spray bar 60 are visible. A toe spray bar and the other side spray bar are similarly situated.

FIG. 5 is a front perspective view of footwear washer 10 with bottom brushes 32 additionally removed. In this view, toe spray bar 62, bottom brush guide 64, and cross shafts 66 are also visible. Each bottom brush 32, when assembled on rack 68, rests and moves on cross shafts 66 or bottom brush guides 64.

Figure 6:
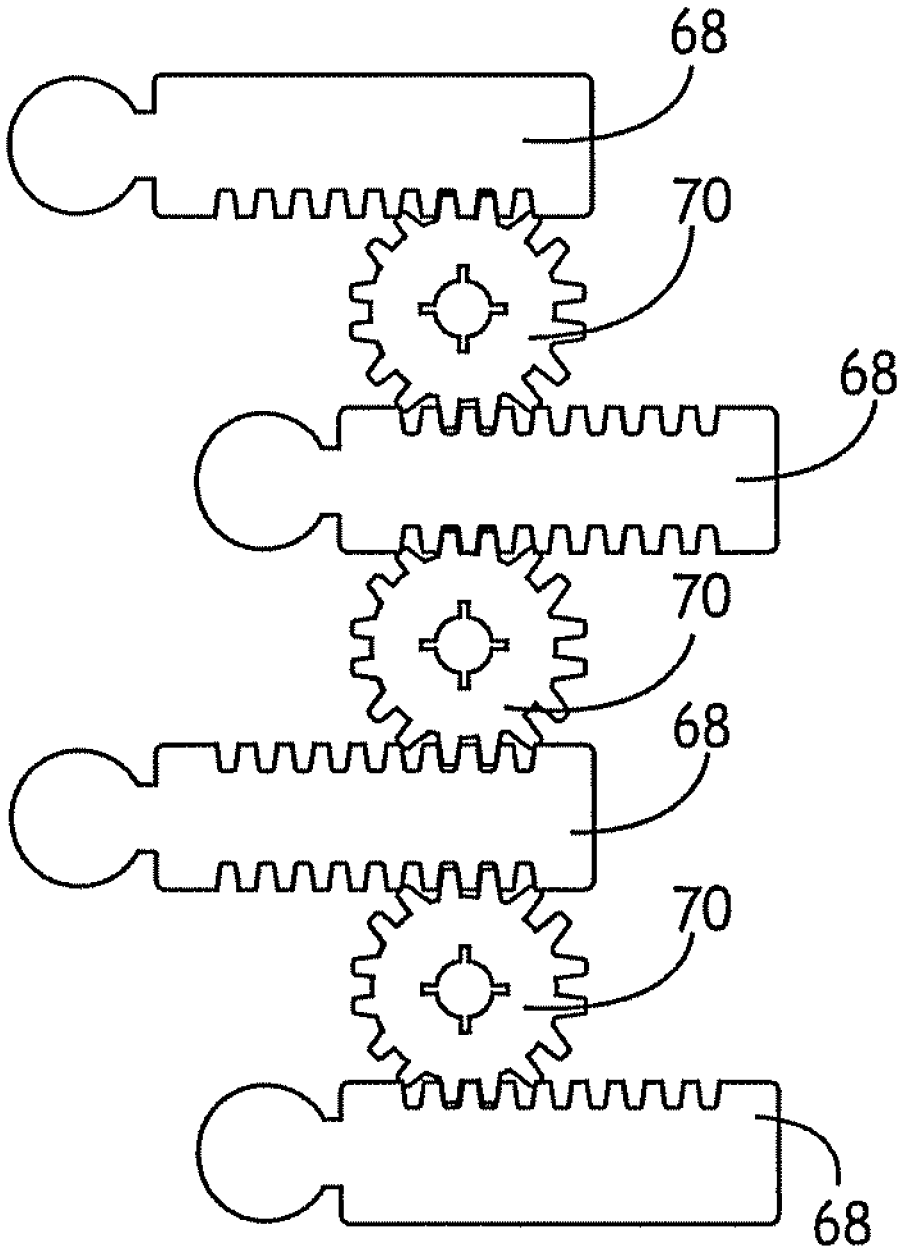
FIG. 6 is a top plan view of an exemplary assembly of bottom brush racks and cooperating gears.

FIG. 6 is a top plan view of an exemplary assembly of racks 68 and gears 70. In an exemplary embodiment, footwear washer 10 has four racks 68, each of which is attached to a bottom brush 32. The racks 68 are interconnected by gears 70, the rotation of which causes adjacent racks 68 to reciprocate in opposite movements in the "x" direction. A maximum displacement between adjacent racks 68 in the "x" direction, in one embodiment, is about 2 inches.

Figure 7:
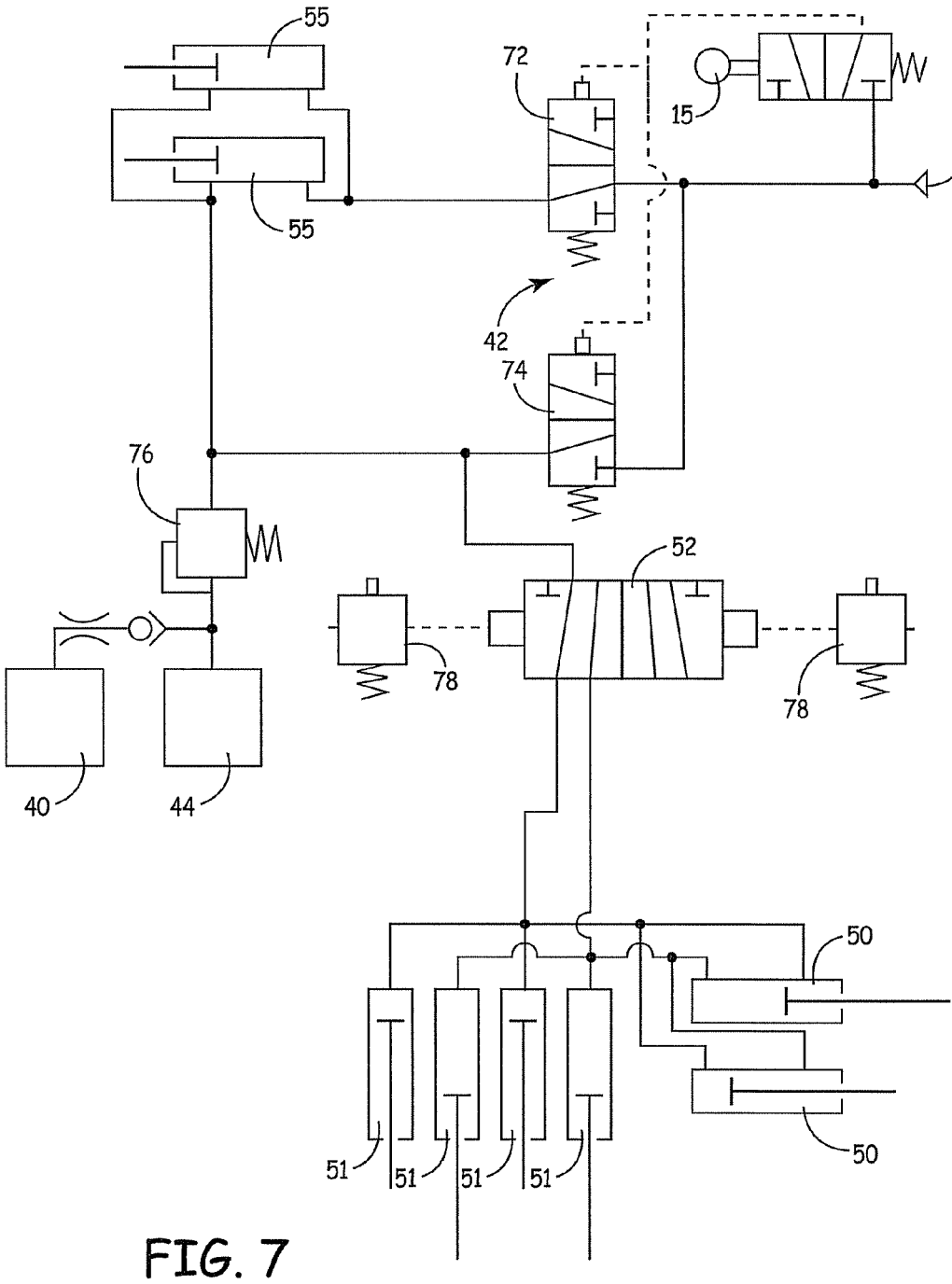
FIG. 7 is an exemplary pneumatic schematic for operation of an exemplary automated footwear washer.

FIG. 7 is a pneumatic schematic showing the interconnection of start valve activation button 15; main air inlet 19; valve assembly 42, which includes squeeze open valve 72 for side brush squeeze cylinders 55 and main inlet valve 74; and reciprocating valve 52, which controls the action of side brush reciprocating cylinders 50 and bottom brush reciprocating cylinders 51. Additionally, regulator 76 is connected to pump 44. Moreover, pilot bleed valves 78 are connected to reciprocating valve 52.

Although the present invention has been described with reference to preferred embodiments, workers skilled in the art will recognize that changes may be made in form and detail without departing from the spirit and scope of the invention.

What is claimed is:

1. An apparatus for cleaning footwear, the apparatus comprising:

a chamber having a toe area, a heel area, two opposed side areas and a bottom area; and two linearly reciprocating side brushes, wherein one side brush is disposed in each side area, each side brush being movable along a first direction;

wherein each of the side brushes is laterally displaceable in a second direction perpendicular to the first direction;

the side brushes having a first position having a first spacing between the side brushes in the second direction when the apparatus is not in operation, and having a second position having a second spacing between the side brushes in the second direction when the apparatus is in operation, the second spacing being less than the first spacing.

2. The apparatus of claim 1 wherein the two side brushes have opposite lateral motions relative to each other.

3. The apparatus of claim 1 having a pneumatic power source.

4. The apparatus of claim 1 further comprising a plurality of linearly reciprocating bottom brushes disposed in the bottom area.

5. The apparatus of claim 4 wherein each bottom brush is movable along a second direction perpendicular to the first direction.

6. The apparatus of claim 4 wherein adjacent bottom brushes have opposite motions relative to each other.

7. The apparatus of claim 4 wherein each side and bottom brush has a plurality of bristles extending from a planar surface.

8. The apparatus of claim 1 further comprising a brush disposed in the toe area.

9. The apparatus of claim 1 further comprising a brush disposed in the heel area.

10. The apparatus of claim 1 further comprising a foam generator.

11. The apparatus of claim 1 further comprising a spray mechanism.

12. The apparatus of claim 1 further comprising a hand rail.

13. The apparatus of claim 12 wherein the hand rail comprises an activation device.

14. An apparatus for cleaning footwear, the apparatus comprising:

a chamber having a toe area, a heel area, two opposed side areas and a bottom area; and two side brushes, wherein one side brush is disposed in each side area, the side brushes being linearly movable toward each other and way from each other along a first direction:

the side brushes having a first position having a first spacing between the side brushes in the first direction when the apparatus is not in operation, and having a second position having a second spacing between the side brushes in the first direction when the apparatus is in operation, the second spacing being less than the first spacing.

15. The apparatus of claim 14 having a pneumatic power source.

16. The apparatus of claim 15 further comprising a plurality of linearly reciprocating bottom brushes disposed in the bottom area.

17. The apparatus of claim 16 wherein each bottom brush is movable along the first direction.

18. The apparatus of claim 16 wherein adjacent bottom brushes have opposite motions relative to each other.

19. The apparatus of claim 16 wherein each side and bottom brush has a plurality of bristles extending from a planar surface.

* * * * *